United States Patent [19]

Sundahl

[11] Patent Number: 4,549,541

[45] Date of Patent: Oct. 29, 1985

[54] HELMET SYSTEM

[75] Inventor: James G. Sundahl, Irvine, Calif.

[73] Assignee: Bell Helmets Inc., Norwalk, Calif.

[21] Appl. No.: 536,282

[22] Filed: Sep. 28, 1983

[51] Int. Cl.[4] ..... A62B 7/00

[52] U.S. Cl. ..... 128/201.19; 128/201.24; 128/201.26; 128/201.29; 128/202.15; 2/2.5; 2/6; 2/421

[58] Field of Search ..... 128/201.22, 201.23, 128/201.24, 201.25, 201.26, 201.27, 201.28, 201.29, 202.11; 2/2.5, 5, 6, 414, 421

[56] References Cited

U.S. PATENT DOCUMENTS

| | | | |
|---|---|---|---|
| 1,903,831 | 4/1933 | Monro | 128/202.15 |
| 3,067,425 | 12/1962 | Colley | 128/201.15 |
| 3,239,843 | 3/1966 | Lobelle | 2/6 |
| 3,310,811 | 3/1967 | Iacono, Jr. | 2/6 |
| 3,345,641 | 10/1967 | Jennings | 128/202.11 |
| 3,362,403 | 1/1968 | Fleming et al. | 128/201.24 |
| 3,487,470 | 1/1970 | Stapenhill | 2/6 |
| 3,688,314 | 9/1972 | Hill | 128/201.24 |
| 3,721,994 | 3/1973 | DeSimone et al. | 2/10 |
| 4,044,400 | 8/1977 | Lewicki | 2/421 |

FOREIGN PATENT DOCUMENTS

| | | | |
|---|---|---|---|
| 2045094 | 10/1980 | United Kingdom | 128/202.15 |

*Primary Examiner*—Henry J. Recla

*Attorney, Agent, or Firm*—William W. Haefliger

[57] ABSTRACT

A protective helmet system comprises:

(a) a protective helmet including a hard outer shell and an impact absorbing liner at the inner side of the shell, the helmet defining a forwardly located viewing gap, and one or two visors at the gap, (b) the helmet having shroud structure to seal off between the helmet and the wearer, thereby to isolate the helmet interior from the exterior, (c) the helmet having inlet port means for entering fluids such as water, oxygen and pressurized air.

A modular container may be provided for the fluids.

13 Claims, 14 Drawing Figures

HELMET SYSTEM

BACKGROUND OF THE INVENTION

This invention relates generally to safety helmet systems, and more particularly to safety helmets to which fluids and electrical signals are supplied in advantageously simple manner.

There exists a need for safety helmet systems of simple, effective and comprehensive construction and operation. Helmets of this type are characterized by required delivery of fluids such as air, water and oxygen, and electrical communication, to and from the helmet interior. No prior helmet system of which I am aware possesses the unusually advantageous structural features, combinations, modes of operation and results as are now afforded by the present invention.

SUMMARY OF THE INVENTION

It is a major object of the invention to provide a helmet system meeting the above need. Basically, the helmet system of the invention comprises:

(a) a protective helmet including a hard outer shell and an impact absorbing liner at the inner side of the shell, the helmet defining a forwardly located viewing gap, and visor means at said gap, (b) the helmet having shroud means to seal off between the helmet and the wearer, thereby to isolate the helmet interior from the exterior, and (c) the helmet having inlet port means for entering fluids.

As will appear, the inlet port is typically located at the rear of the helmet; exterior duct means connect with the helmet to supply the fluids via the rear inlet port; and the duct means typically includes a first duct to supply pressurized air, a second duct to supply water, and a third duct to supply oxygen, the second and third ducts located within the first duct. In addition wiring from external circuitry, may extend into the helmet interior via the first duct and the rear entry port.

Further, the visor means may advantageously include first and second visors supported by the helmet to pivot independently between up and down positions, each visor extending crosswise of and in registration with said viewing gap, and a housing on the helmet to receive both visors in said up position. Visor actuators may be located on the two visors to be manually accessible for lifting and lowering them, as required.

An exterior support module may be employed to supply water and oxygen to the helmet interior in addition to air which is filtered, pressurized and temperature controlled.

Finally, the helmet interior may be provided with an unusually effective support harness; ear cups to filter out unwanted noise, a microphone and loudspeakers, an expansible oxygen mask, a water spout, and ballast. The helmet is easily disconnectible from the external support system, as will appear.

These and other objects and advantages of the invention, as well as the details of an illustrative embodiment, will be more fully understood from the following specification and drawings, in which:

DRAWING DESCRIPTION

Figure 13A:
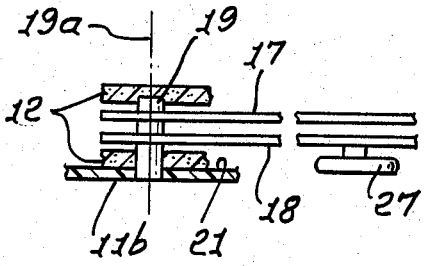
Figure 11:
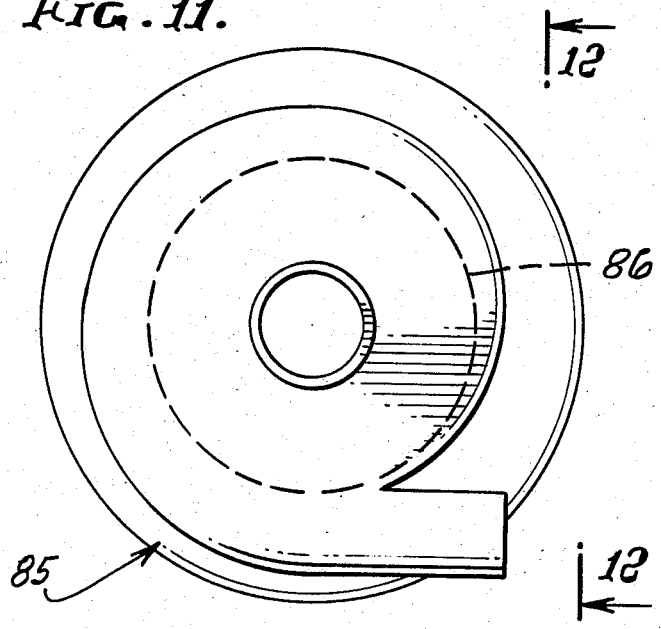
Figure 12:
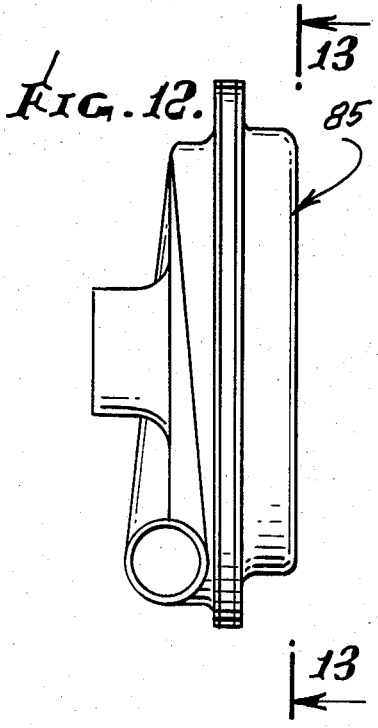
Figure 13:
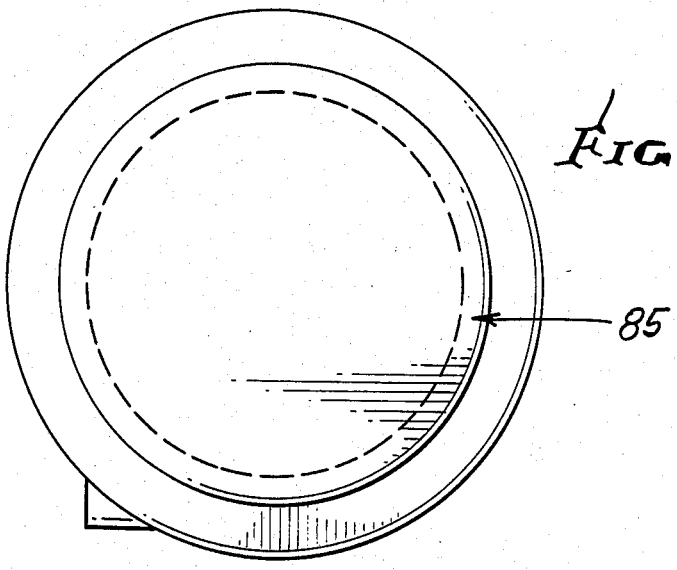
Figure 4:
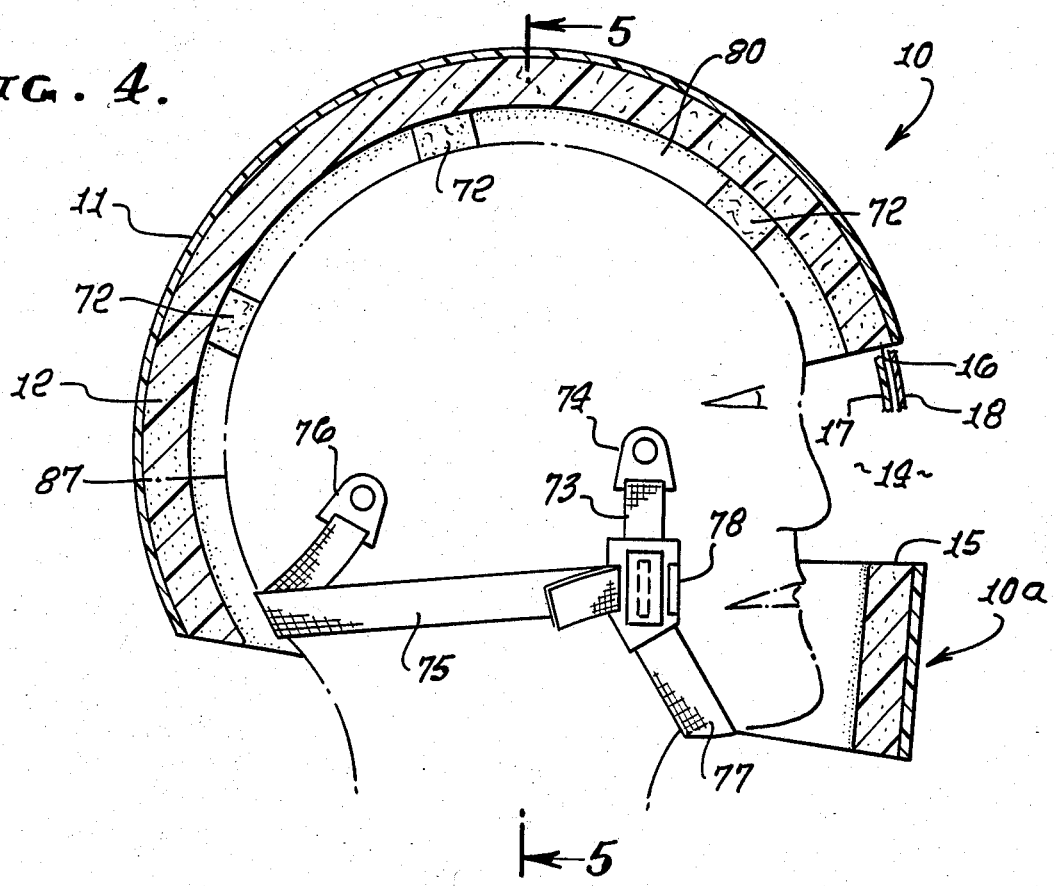
FIG. 4 is a vertical section taken through the FIG. 1 helmet on lines 4—4 of FIG. 2.
Figure 5:
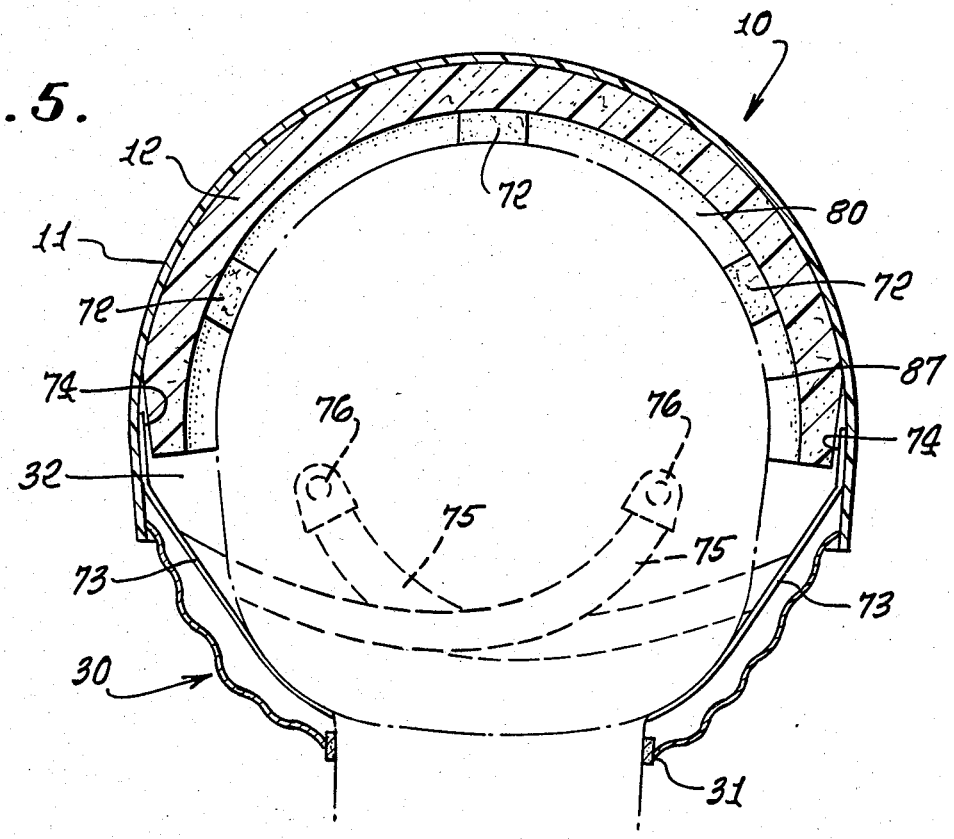
FIG. 5 is a vertical elevation taken through the FIG. 1 helmet on lines 5—5 of FIG. 4.
Figure 6:
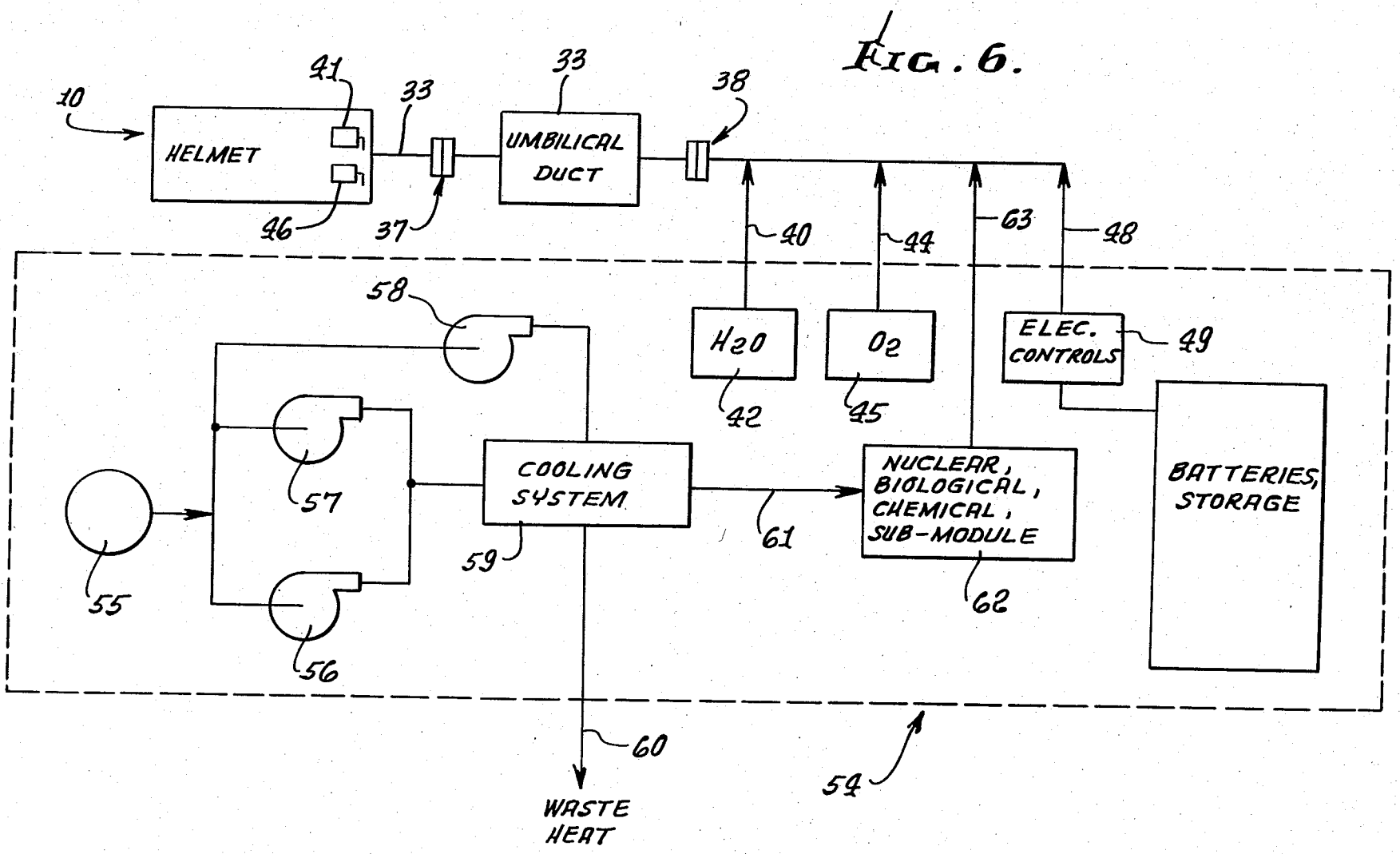
FIG. 6 is a block diagram of the fluids and electrical control system employed with the FIG. 1 helmet.
Figure 8:
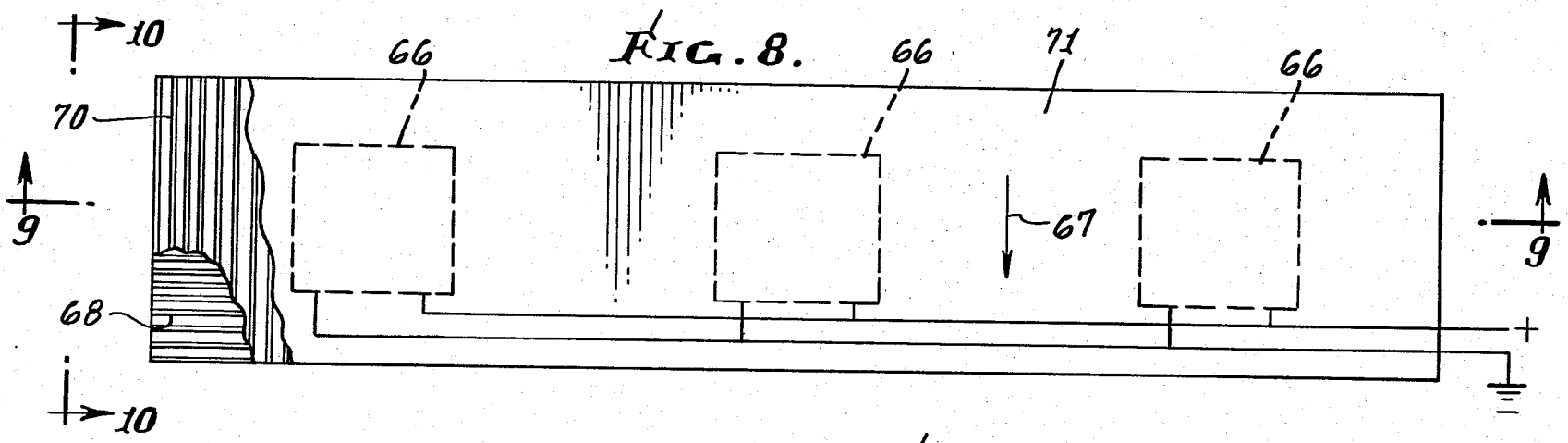
FIG. 8 is a plan view of a heat exchanger employed in FIG. 6.
Figure 9:
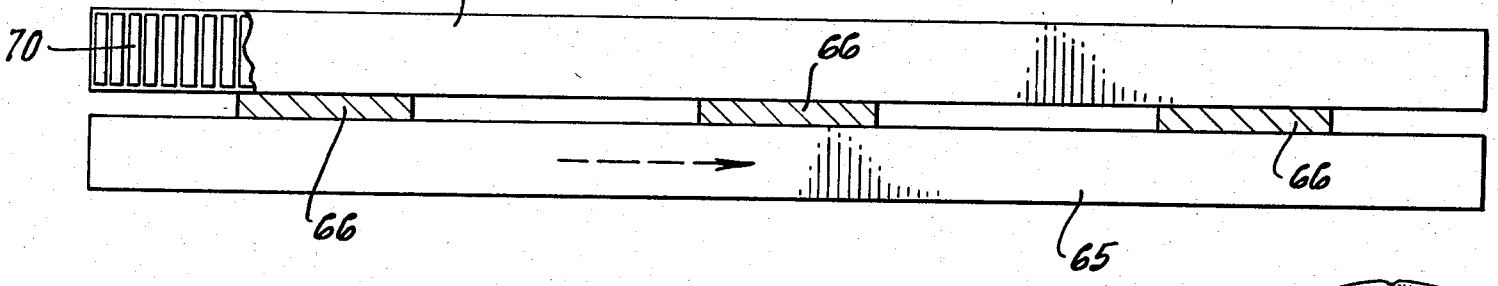
FIG. 9 is a section taken on lines 9—9 of FIG. 8.

FIGS. 11, 12 and 13 are front, side and end views of a cooling blower and motor assembly employed in FIG. 6, with FIGS. 12 and 13 taken on lines 12—12 of FIG. 11, and lines 13—13 of FIG. 12, respectively.

FIG. 13*a* is a fragmentary section showing visor pivot support.

DETAILED DESCRIPTION

The protective helmet system shown in FIGS. 1-5 includes a helmet 10 having a hard outer shell 11 and a crushable or impact softening liner 12 at the inner side of the outer shell. The shell may for example consist of glass fiber impregnated polyester resin for high impact resistance, and the liner may for example consist of expandable polystyrene having a density of about 25-33 kg/m$^3$. Other materials are usable. The helmet includes a face piece 10*a* projecting forwardly of the lower face including the chin of the wearer, and it too may include an outer shell and inner liner, as described. The helmet defines a forwardly located viewing gap 14 which wraps about the front and opposite sides of the helmet to rearward location 14*a*. Gap 14 is defined between the upper curved edge extent 15 of the face piece, and lower brow extent 16 of the helmet, as shown.

Figure 3:
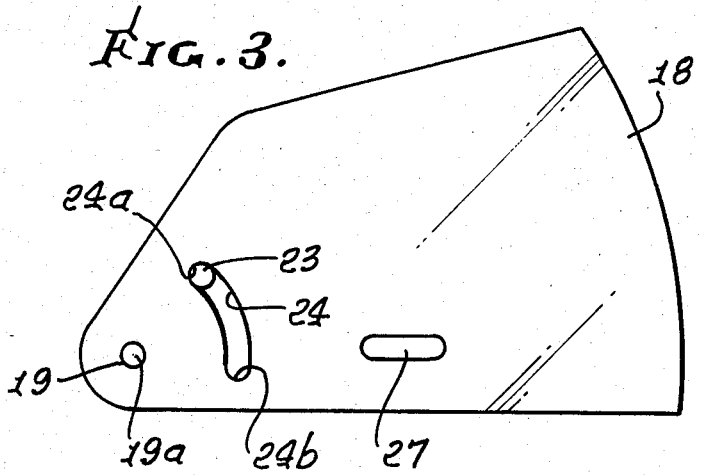
FIG. 3 is a side elevational view of a visor employed in FIG. 1.

Visor means is associated with the gap 14 to optically cover the latter. The visor means may advantageously include dual (inner and outer) visors 17 and 18 which wrap about the front of the helmet in registration with one another and with the gap 14. The visors extend rearwardly at inner opposite sides of the helmet to two pivot pin locations 19 having a common transverse axis 19*a*. See FIG. 13*a*. The visors are independently pivotable about axis 19*a* between down positions, as shown at A and B (full lines) in FIG. 1, and up-position as shown at A' and B' (broken lines), wherein they are received in a housing or receptacle 21 defined by the helmet, inwardly of the shell upper frontal extent 11*b*. FIG. 3 shows a detent pin 23 extending in a visor slot 24 and engaging slot upper shoulder 24*a* to limit down-swinging of the visor 18. Upward swinging of the visor is limited by engagement of detent pin 23 with slot lower shoulder 24*b*. Pin 23 may be anchored in the liner material 12, the latter defining a housing forming a recess 26 for the two visors. Similar detent and slot structure is provided at the opposite side of the helmet on liner 17. A visor lifting tab actuator or actuators are also provided.

Figure 1:
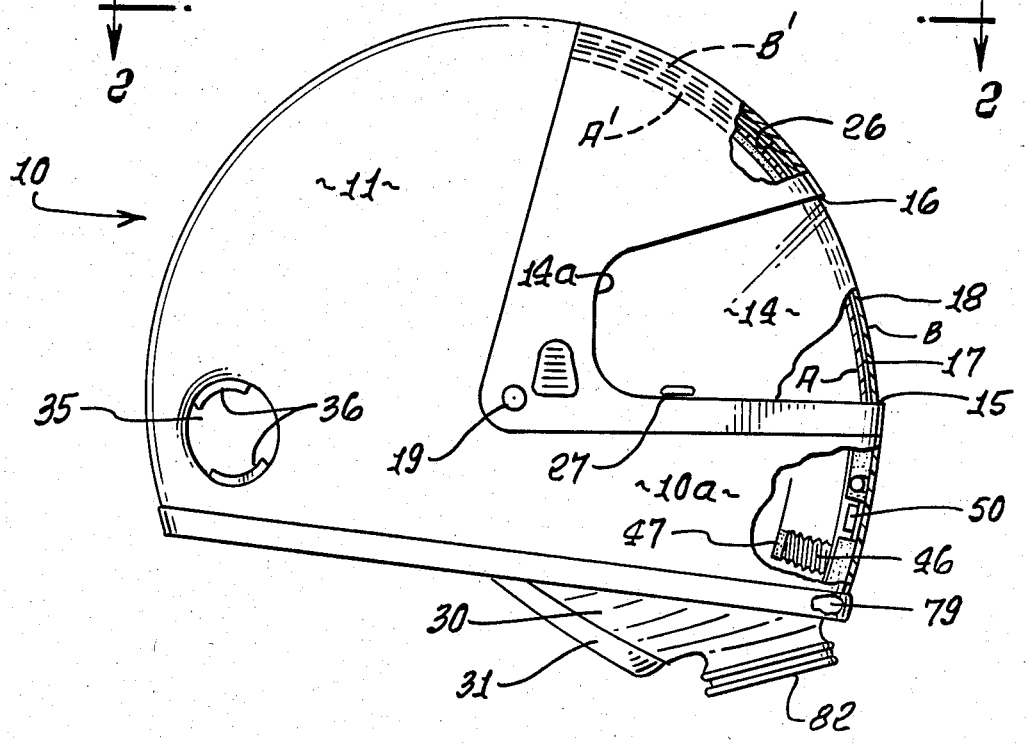
FIG. 1 is a right side elevational view of a helmet incorporating the invention.
Figure 2:
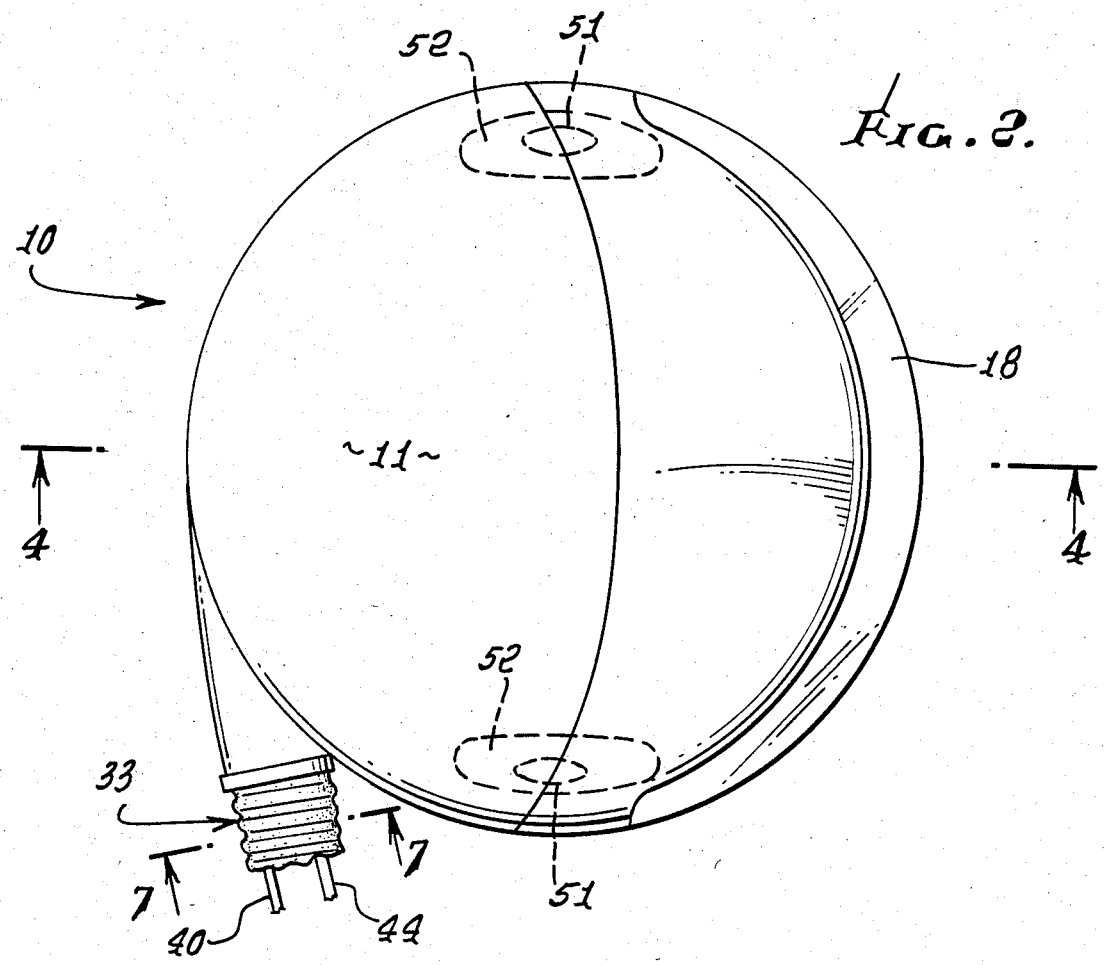
FIG. 2 is a top plan view taken on lines 2—2 of FIG. 1.

FIGS. 1 and 3 show a tab actuator 27 at the outside of the visor 18 to be manually pushed upward to raise visor 18, and pushed downward to lower it. A similar tab may be provided at the opposite side of the helmet to raise and lower visor 17 when visor 18 is raised. The tabs 27 travel in arcs larger than the slots 24 for mechanical advantage. Positive detents may releasably retain the visors in raised or lowered positions. The visors may consist of the same clear transparent plastic material (as for example polycarbonate), or one or both may be darkened. Dual visors provide dual protecion, as during impact.

Also provided is shroud means 30 suspended by the helmet to seal off between lower extent of the helmet and the wearer's neck. See FIGS. 1 and 5 and neck ring elastic 31. Interior 32 of the helmet is thereby effectively isolated from the exterior. As will be seen, air under pressure is delivered to the helmet interior, as via flexible ducting 33, the air exhausting via a check valve 82 under the wearer's chin, whereby exterior air (which may be contaminated by poisonous gases, or radiation contaminated gases) cannot gain entrance to the helmet interior.

Figure 7:
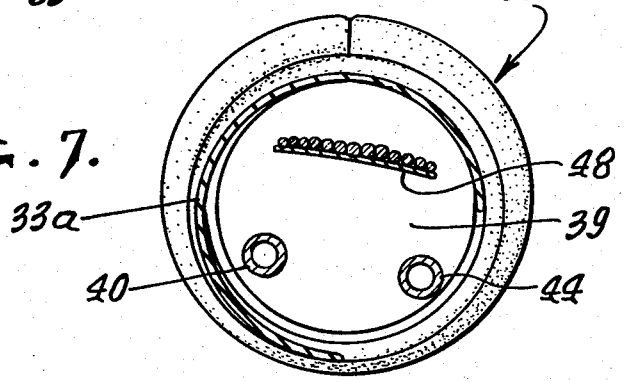
FIG. 7 is a section taken on lines 7—7 of FIG. 2 through ducting via which fluids and electrical wiring pass to the helmet from the FIG. 6 supply system.
Figure 10:
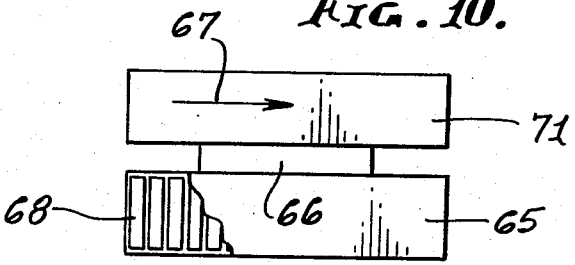
FIG. 10 is an end view taken on lines 10—10 of FIG. 8.

The helmet also has inlet port means for entering fluids, as for example pressurized air (heated or cooled), oxygen, water, and for electrical wiring. See for example inlet port 35 located at the rear of the helmet, whereby ducting 33 extending to that opening is away from interfering relation with the wearer's chest and arms. A suitable rotary disconnect coupling may be provided with openings, tongues 36 in FIG. 1 being provided to engage corresponding tongues at the connecting end of the ducting. See coupling designated schematically at 37 in FIG. 6, and a second and similar rapidly disconnectible coupling provided at 38 at opposite ends of flexible umbilical ducting 33. Ducting 33 includes a flexible outer or first duct 33*a* defining a passage 39 for pressurized air supply to the helmet interior, for breathing use by the wearer. The duct means also is shown to include a second and smaller duct 40 to supply water to a valved outlet 41 (see FIG. 6) in the helmet. The wearer may lift his visors and insert the outlet in his mouth to receive drinking water at ambiant pressure when he presses on the valved outlet with his lips. Outlet 41 may be opened, and the wearer may receive water by suction on that outlet. Duct 40 extends within duct 33, as shown in FIG. 7. A water source is shown at 42 in FIG. 6.

The duct means may also include a third duct 44 to supply oxygen to the wearer, on demand. Duct or line 44 also extends from source 45 via the interior of duct 33 and to an inflatable bellows 46 (see FIG. 1) at the inner side of the face piece 10*a*. A face seal 47 on the bellows is engageable with the wearer's mouth to supply oxygen, on demand.

Also located within ducting, as is clear from FIG. 7, is ribbon wiring 48, which provides electrical connection between external circuitry 49 (see FIG. 6) and electrical components in the helmet, such as microphone 50, and loudspeakers 51, which are located within cushioning ear cups 52. See the latter in FIG. 2, wherein they are located at the inner side of the lining at the left and right side of the helmet to mask out noise such as air blown noise transmitted via duct 33 to the helmet interior, engine noise, etc. The disconnect couplings at 37 and 38 may also include simple pull-apart connectors between end-to-end sections of the wiring 48, sections of duct 40 and sections of duct 44.

FIG. 6 also illustrates a modular container 54, located for example within a vehicle transporting the wearer, and containing the sources 42, 45 and controls 49. Also located in the container are filter means, blower means and cooling (or heating) means, for the air supplied via duct 33. As shown, supply air passes through a pre-filter 55, and then to blowers 56–58. Contaminants are removed by the filter. The redundant blowers 56 and 57 pressurize the air and pass it to the heat exchanger 59 wherein the air is cooled (or heated) to correct temperature. The air to blower 58 is also passed by that blower to the exchanger 59 for scavenging rejected waste heat to exhaust at 60. From the heat exchanger the air passes at 61 to the main filter 62, wherein any remaining contaminant (biological—such as poisons, nuclear—such as radiation particles—and chemicals) are removed. The filtered, pressurized, controlled temperature air then passes at 63 to duct 33.

FIGS. 8–13 show a usable heat exchanger apparatus. Air flows from left to right in elongated chamber 65, wherein heat is exchanged via thermo electric heat pumps 66, typically operating to produce the temperature and temperature changes indicated, these being illustrative only. Waste heat is carried off by air from auxiliary blower 58, in paths indicated by arrows 67. Note longitudinal fins 68 to guide air flow from left to right in chamber 65 in FIGS. 8 and 9; and fins 70 to guide exhaust heated transverse air flow in adjacent chamber 71. FIGS. 11–13 show typical blower constructions, with motors 85 and impellers 86.

Referring again to FIGS. 4 and 5, the helmet may be suitably suspended on the wearer's head as for example by foam cushion blocks 72 attached to the liner. Other suspensions are usable, and an air gap 80 provides for cooling of the head (circulation of pressurized air). A harness to firmly connect the helmet to the wearer's head 87 includes left and right side anchor straps 73 connected to opposite sides of the helmet, as at 74. The harness also includes two cross-over nape straps 75 end connected at 76 with rear portions of the helmet. A chin strap 77 passes under the chin and adjustably connects with two retainers 78 at opposite sides of the helmet. The straps 73 and 75 also connect to the retainers, as shown. Note that the shell and liner are typically and advantageously hemispherical, to accommodate the interior structures and liners, as described. Finally, ballast may be carried by the helmet, as indicated at 79, to balance the helmet on the head of the wearer, and a check valve air outlet-back pressure regulator is shown at 82.

I claim:

1. In a protective helmet system, the combination comprising:

(a) a protective helmet including a hard outer shell and an impact absorbing liner at the inner side of the shell, the helmet defining a forwardly located viewing gap, and visor means movably mounted on said helmet to extend, over said gap, (b) the helmet having shroud means to seal off between the helmet and the wearer, thereby to isolate the helmet interior from the exterior, (c) the helmet having inlet port means for entering fluids, (d) and including exterior duct means connected with the helmet to supply said fluids via said inlet port means, said duct means including a flexible first duct connected to said inlet port means to supply pressurized air to the interior of said helmet, a second duct to supply water and a third duct to supply oxygen, said second and third ducts extending within said first duct to the interior of said helmet in the vicinity of said gap, and means connected to said second and third ducts for selectively delivering said water and oxygen to a user.

2. The combination of claim 1 wherein said inlet port means is located at the rear of the helmet.

3. The combination of claim 1 wherein said visor means comprises first and second visors supported by the helmet to pivot independently between up and down positions, each visor extending crosswise of and in registration with said viewing gap, there being pivot means operatively connecting the visors to the helmet to enable said pivoting of the visors, and a housing on the helmet to receive both visors in said up position.

4. The combination of claim 3 including first and second actuators located on the visors to be manually accessible for independently actuating said pivoting of the respective first and second visors.

5. The combination of claim 1 wherein the helmet has hemispherical configuration.

6. The combination of claim 5 including ballast carried by the helmet at a lower portion thereof for balance of the helmet on the head of the wearer.

7. The combination of claim 1 including exterior supply means including (i) pressurized air, (ii) oxygen, and (iii) water, connected to said first, second and third ducts, respectively.

8. The combination of claim 7 wherein said exterior supply means includes an air filter means, air blower means having an inlet connected to said air filter and an outlet, and air cooling means having an inlet connected to the outlet of said air blower means and an outlet connected to said first duct.

9. The combination of claim 7 wherein said supply means also includes a modular container for said sources, and said filter, blower and cooling means, there being electrical control means also carried by said container, electrical wiring extending from said electrical control means to the helmet interior, and microphone means mounted in said helmet and electrically connected with said electrical control means via said wiring.

10. The combination of claim 9 wherein said electrical wiring extends within said first duct and to the helmet interior, and at least one loudspeaker means mounted in said helmet and electrically connected said electrical control means via said wiring.

11. The combination of claim 1 wherein the helmet includes a face piece and adapted to extend frontwardly of the wearer's lower face, said viewing gap located above said face piece, and harness means for connecting the helmet to the wearer's head.

12. The combination of claim 1 wherein the harness means includes two anchor straps having first ends connected with opposite inner sides of the helmet and second ends extending downwardly therefrom, two nape straps having first ends connected with opposite inner rear portions of the helmet criss-crossing each other at the rear of the helmet and extending forwardly along opposite inner sides of the helmet and terminating in opposite second ends, a chin strap, and two strap retainers, each retainer connected respectively with a second end of the anchor strap and nape strap, and with an end of the chin strap.

13. The combination of claim 1 wherein the helmet includes a face piece, and said delivering means includes an oxygen mask on said face piece portion of the helmet, and communicating with said third duct.

* * * * *